US006357276B1

(12) United States Patent
Koehler et al.

(10) Patent No.: US 6,357,276 B1
(45) Date of Patent: Mar. 19, 2002

(54) SYSTEM AND METHOD FOR CALIBRATING A INDEPENDENT METERING VALVE

(75) Inventors: Douglas W. Koehler, Peoria, IL (US); Dennis J. Hausman, Willow Spring, NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/378,455

(22) Filed: Aug. 20, 1999

Related U.S. Application Data

(63) Continuation-in-part of application No. 08/984,313, filed on Dec. 3, 1997, now abandoned.

(51) Int. Cl.[7] ..... F61D 31/00
(52) U.S. Cl. ..... 73/1.01
(58) Field of Search ..... 73/1.01, 1.16, 73/1.36, 1.68; 91/444, 454, 457, 462

(56) References Cited

U.S. PATENT DOCUMENTS 4,299,593 A * 11/1981 Dopp
5,813,226 A * 9/1998 Krone et al.

* cited by examiner

*Primary Examiner*—Robert Raevis
(74) *Attorney, Agent, or Firm*—J. W. Burrows; Calvin E. Glastetter

(57) ABSTRACT

A system for controlling an independent metering valve having a pair of independently controlled electrohydraulic displacement controlled spool valves for controlling pump-to-cylinder communication between an inlet port and a pair of control ports and another pair of independently controlled electrohydraulic displacement controlled spool valves for controlling cylinder-to-tank fluid flow between the control ports and an outlet port. The spool valves of the independent metering valve are calibrated to provide the required fluid flow.

8 Claims, 1 Drawing Sheet

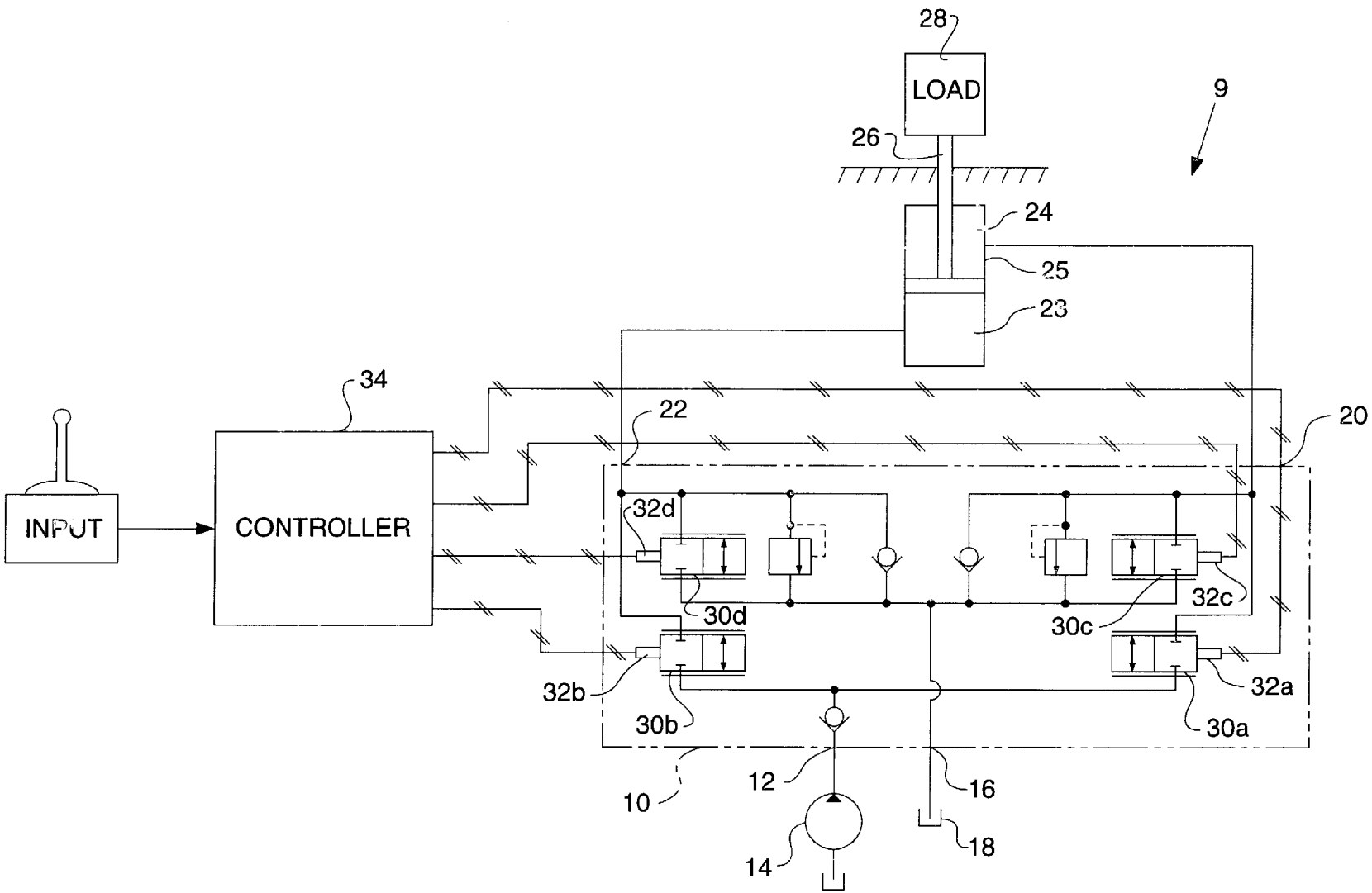
9
20
32a
30a
32c
30c
24
25
23
28
LOAD
26
16
18
12
14
22
32d
30d
30b
10
32b
34
CONTROLLER
INPUT

SYSTEM AND METHOD FOR CALIBRATING A INDEPENDENT METERING VALVE

This application is a continuation-in-part of application Ser. No. 08/984,313 filed Dec. 3, 1997, now abandoned.

TECHNICAL FIELD

This invention relates to a independent metering valve and, more particularly, to an independent metering valve having four independently operable electrohydraulic displacement controlled metering spool valves and method for calibrating the spool valves.

BACKGROUND ART

Controlling an operation of a hydraulic output device in a hydraulic circuit is conventionally accomplished using a single spool type valve. The single spool valve has a series of metering slots which control flows of hydraulic fluid in the hydraulic circuit including a flow from a pump to the hydraulic output device and a flow from the hydraulic output device to a tank. When the hydraulic output device is a hydraulic cylinder, these flows are commonly referred to as pump-to-cylinder flow and cylinder-to-tank, respectively.

The metering slots are machined into the stem of the spool valve. With this arrangement, slot timing and modulation are fixed. In order to modify the performance of the hydraulic circuit, the stem must be remachined. Furthermore, in order to add features to the performance of the hydraulic circuit, an entirely new stem may be required. This makes adding features or optimizing the performance of the hydraulic circuit expensive and time consuming.

DISCLOSURE OF THE INVENTION

In one aspect of the present invention, a system for calibrating a independent metering valve is provided. The system includes an actuator having a first and second actuating chamber. The metering valve includes an input port, an output port, and a pair of control ports. A first independently operable electrohydraulic displacement controlled spool valve is disposed between the input port and the control ports and is moveable between a open position and a closed position. A second independently operable electrohydraulic displacement controlled spool valve is disposed between the input port and the control ports and is moveable between a open position and a closed position. A third independently operable electrohydraulic displacement controlled spool valve is disposed between the outlet port and the control ports and is moveable between a open position and a closed position. A fourth independently operable electrohydraulic displacement controlled spool valve is disposed between the outlet port and the control ports. A controller positions three of the spool valves and slowly moves one of the valves from the closed position toward the open position until fluid from the actuating chamber is allowed to flow through the moving valve and the position at which fluid is produced is used for calibrating the valve.

In another aspect of the present invention, a method of calibrating an independent metering valve having a first independently operable electrohydraulic displacement controlled spool valve disposed between an input port connected to a pump and a first control port connected to a head end chamber of a hydraulic actuator, a second independently operable electrohydraulic displacement controlled spool valve disposed between the input port and a second control port connected to a rod end chamber of the hydraulic actuator, and third and fourth independently operable electrohydraulic displacement controlled spool valves disposed between an outlet port and the first and second control ports, respectively, the method comprising the steps; positioning three of the spool valves to one of a closed position and a closed position, moving one of the spool valves from a closed position toward a open position until fluid from the actuating chamber is allowed to flow through the moving valve, and recording the position at which fluid flow is produced through the valve and this position to be used as an offset whenever the valve is used.

BRIEF DESCRIPTION OF THE DRAWINGS

The sole FIGURE is a schematic illustration of the present invention.

BEST MODE FOR CARRYING OUT THE INVENTION

A system 9 is provided for controlling a independent metering valve 10. The independent valve 10 includes a inlet port 12 connected to a supply pump 14, a outlet port 16 connected to a tank 18, and a pair of control ports 20,22 connected to a head end chamber 23 and a rod end chamber 24 of a hydraulic actuator 25, such as a hydraulic cylinder. The actuator 25 includes a piston rod 26 connected to a load 28. The metering valve 10 includes a first independently operable electrohydraulic displacement controlled flow metering spool valve 30*a* disposed between the inlet port 12 and the control port 20, a second independently operable electrohydraulic displacement controlled flow metering spool valve 30*b* disposed between the inlet port 12 and the control port 22, a third independently operable electrohydraulic displaceable controlled flow metering spool valve 30*c* disposed between the control port 20 and the outlet port 16, and a fourth independently operable electrohydraulic displaceable controlled flow metering spool valve 30*d* disposed between the control port 22 and the outlet port 16. The spool valves 30*a*,30*b* control pump-to-cylinder fluid flow to the actuating chambers and the spool valves 30*c*,30*d* control cylinder-to-tank flow from the actuating chambers to the tank. The metering valve 30*a* is referred to as being a pump-to-cylinder head end (PCHE) metering valve. The metering valve 30*b* is referred to as being a pump-to-cylinder rod end (PCRE) metering valve. The metering valve 30*c* is referred to as being a cylinder-to-tank head end (CTHE) metering valve. The metering valve 30*d* is referred to as being a cylinder-to-tank rod end (CTRE) metering valve.

Each of the spool valves 30*a*,30*b*,30*c*,30*d* include a solenoid 32*a*,32*b*,32*c*,32*d* for receiving a control signal from a controller 34 for actuating the respective spool valve. Each valve has a closed position wherein fluid flow through the valve is blocked, a open position wherein the valve is fully open and a metering position wherein the valve is partially open in proportion to the control signal. In the present invention the slow ramp movement of the valve from the closed position to the initial metering opening and positioning of the remaining valves is used to calibrate the valve. Each of the spool valves are substantially identical.

Table I summarizes the position of all the spool valves 30*a*,30*b*,30*c*,30*d* for calibrating one of the valves.

TABLE I

| Valve Being Calibrated | Valve Calibration | | | |
|---|---|---|---|---|
| | PCHE | PCRE | CTHE | CTRE |
| PCHE | Slow Ramp | Open | Closed | Open |
| PCRE | Open | Slow Ramp | Closed | Open |
| CTHE | Closed | Closed | Slow Ramp | Closed |
| CTRE | Open | Open | Closed | Slow Ramp |

INDUSTRIAL APPLICABILITY

In use the independent metering valve 10 relies on precise positioning in order to provide the required flow area for pump-to-cylinder and cylinder-to-tank with a generic spool valve. In order to achieve the precise positioning the independent metering valve must be calibrated. The calibration procedure begins by applying a constant pressure to one control port of the independent metering valve. On a test stand this could consist of a fixed displacement pump flow over a relief or a variable displacement pump with a high pressure cutoff or any other suitable means. If the independent metering valve is calibrated on a machine a constant pressure source can be obtained by positioning the circuit with gravitational potential sufficient to overcome frictional forces in the actuator. This can be achieved by the actuator supporting a load.

The system 9 is shown as a working system for controlling the independent metering valve 10 for positioning the hydraulic actuator 25. The system 9 will be described with the load being used to act on the actuator. When the independent metering valve 10 is being calibrated on a machine the pump is only used to fill the hydraulic actuator and preposition the load 28 which is used in calibrating the spool valve. During the calibration procedure the pump is inoperative and is not used to supply fluid to the system 9.

During calibration the load and three spool valve are prepositioned and the spool valve being calibrated is slowly moved from the closed toward the open position. The load pushes down on the piston rod 26 to expel fluid from the chamber 23. With the pump being inoperative during calibration fluid will not be pumped in the chamber. Fluid expelled from the chamber 23 will go to the tank 18 or to the chamber 24.

The procedure begins by determining the point at which flow begins through the spool valve being calibrated, this is commonly referred to as the cracking point. The command is slowly increased to the spool valve being calibrated to slowly ramp up or move the valve from the closed position to the metering position.

For calibrating the CTHE valve 30*c*, the PCHE valve 30*a*, the PCRE valve 30*b* and the CTRE valve 30*d* are maintained in the closed position and the CTHE 30*c* is slowly moved from the closed position toward the open position. The CTHE valve 30*c* is moved until fluid flow therethrough is detected. The fluid is expelled from the head end chamber 23 through the CTHE valve 30*c* into the tank 18. The load 28 pushes the piston rod 26 down, as viewed in the drawing, and expels the fluid from the chamber 23. The command which produced the fluid flow is thereafter used as an offset whenever the CTHE valve 30*c* is commanded.

For calibrating the PCHE valve 30*a*, the CTHE valve 30*c* is closed, the PCRE valve 30*b* and the CTRE valve 30*d* are both fully open and the PCHE valve 30*a* is slowly moved from the closed position toward the open position. The PCHE valve 30*a* is moved until fluid flow therethrough is detected. The fluid is expelled from the head end chamber 23 through the PCHE valve 30*a*, the PCRE valve 30*b* and the CTRE valve 30*d* into the tank 18. The command which produced the fluid flow is thereafter used as an offset whenever the PCHE valve 30*a* is commanded.

For calibrating the PCRE valve 30*b*, the CTHE valve 30*c* is closed, the PCHE valve 30*a* and the CTRE valve 30*d* are both fully open and the PCRE valve 30*b* is slowly moved from the closed position toward the open position. The PCRE valve 30*b* is moved until fluid flow therethrough is detected. The fluid is expelled from the head end chamber 23 through the PCHE valve 30*a*, the PCRE valve 30*b* and the CTRE valve 30*d* into the tank 18. The command which produced the fluid flow is thereafter used as an offset whenever the PCRE valve 30*b* is commanded.

For calibrating the CTRE valve 30*d*, the CTHE valve 30*c* is closed, the PCHE valve 30*a* and the PCRE 30*b* are both fully open and the CTRE valve 30*d* is slowly moved from the closed position toward the open position. The CTRE valve 30*d* is moved until fluid flow therethrough is detected. The fluid is expelled from the head end chamber 23 through the PCHE valve 30*a*, the PCRE valve 30*b* and the CTRE valve 30*d* into the tank 18. The command which produced the fluid flow is thereafter used as an offset whenever the CTRE valve 30*d* is commanded.

In view of the forgoing, it is readily apparent that the structure of the subject invention provides a method for calibrating a control valve having four independently operable spool valves employed to control fluid flow into and out of the actuating chamber of a hydraulic cylinder. By calibrating each spool valve the pump-to-cylinder fluid flow and the cylinder-to-tank fluid can be precisely controlled to accommodate various operating conditions imposed upon the hydraulic cylinder. The calibration method will account for effects such as dead band, tolerances, etc. and can be used to preposition the spool valve in anticipation of movement.

Other aspects, objects and advantages of this invention can be obtained from a study of the drawing, the disclosure and the appended claims.

What is claimed is:

1. A system for calibrating a independent metering valve comprising:

an actuator having first and second actuating chambers;

an input port;

an output port;

a pair of control ports;

a first independently operable electrohydraulic displacement controlled spool valve disposed between the input port and one of the control ports and being moveable between a open position and a closed position;

a second independently operable electrohydraulic displacement controlled spool valve disposed between the input port and one of the control ports and being moveable between a open position and a closed position;

a third independently operable electrohydraulic displacement controlled spool valve disposed between the outlet port and one of the control ports and being moveable between a open and a closed position;

a fourth independently operable electrohydraulic displacement controlled spool valve disposed between the outlet port and one of the control ports and being moveable between a open position and a closed position; and a controller for positioning three of the spool valves and slowly moving one spool valve from the closed position toward the open position until fluid from one of the actuating chambers is allowed to flow through the one spool valve and the position at which fluid flow is produced therethrough is used for calibrating the valve.

2. The system of claim 1 including a relief valve disposed between one of the control ports and the outlet port.

3. The system of claim 1 wherein each of the spool valves is solenoid actuated.

4. A method of calibrating an independent metering valve having a first independently operable electrohydraulic displacement controlled spool valve disposed between an input port connected to a pump and a first control port connected to a head end chamber of a hydraulic actuator, a second independently operable electrohydraulic displacement controlled spool valve disposed between the input port and a second control port connected to a rod end chamber of the hydraulic actuator, and third and fourth independently operable electrohydraulic displacement controlled spool valves disposed between an outlet port and the first and second control ports, respectively, the method comprising the steps;

positioning three of the spool valves to one of a closed position and a open position;

moving one of the spool valves from a closed position toward a open position until fluid from the actuating chamber is allowed to flow through the moving valve; and recording the position at which fluid flow is produced through the valve and this position to be used as an offset whenever the valve is used.

5. The method of claim 1 for calibrating the first spool valve, comprising the steps of:

opening the second spool valve to communicate the input port with the second control port;

closing the third and fourth spool valves preventing fluid flow therethrough; and moving the first spool valve from the closed position toward the open position until a fluid flow therethrough is produced.

6. The method of claim 1 for calibrating the second spool valve, comprising the steps of:

opening the first spool valve to communicate the input port with the first control port;

closing the third spool valve preventing fluid flow therethrough;

opening the fourth spool valve to communicate the second control port with the outlet port; and moving the second spool valve from the closed position toward the open position until a fluid flow therethrough is produced.

7. The method of claim 1 for calibrating the third spool valve, comprising the steps of:

closing the first, second, and fourth spool valve preventing fluid flow therethrough; and moving the third spool valve from the closed position toward the open position until a fluid flow therethrough is produced.

8. The method of claim 1 for calibrating the fourth spool valve, comprising the steps of;

opening the first spool valve to communicate the input port with the first control port;

opening the second spool valve to communicate the input port with the second control port;

closing the third spool valve preventing fluid flow therethrough; and moving the fourth spool valve from the closed position toward the open position until a fluid flow therethrough is produced.

* * * * *